US005472202A

United States Patent [19]

Yamanaka

[11] Patent Number: 5,472,202

[45] Date of Patent: Dec. 5, 1995

[54] GOLF CLUB TREATED WITH PLATING

[76] Inventor: Harufumi Yamanaka, 12-14, Tokumaru-6-chome, Itabashi-ku, Tokyo, Japan

[21] Appl. No.: 281,064

[22] Filed: Jul. 26, 1994

[30] Foreign Application Priority Data

Aug. 27, 1993 [JP] Japan ..... 5-213104

[51] Int. Cl.[6] ..... A63B 53/04

[52] U.S. Cl. ..... 273/167 R; 273/167 J

[58] Field of Search ..... 273/167 R, 77 R, 273/167 J, 167 H, 169, DIG. 23, DIG. 7

[56] References Cited

U.S. PATENT DOCUMENTS

| | | | |
|---|---|---|---|
| 3,955,820 | 5/1976 | Cochran | 273/167 F |
| 4,390,184 | 6/1983 | Rudell | 273/164.1 |
| 4,793,616 | 12/1988 | Fernandez | 273/167 H |
| 5,207,427 | 5/1993 | Saeki | 273/167 R |

FOREIGN PATENT DOCUMENTS

| | | | |
|---|---|---|---|
| 6363288 | 4/1980 | Japan . | |
| 2080070 | 3/1990 | Japan | 273/167 R |
| 4-146771 | 5/1992 | Japan | 273/167 R |
| 5-115584 | 5/1993 | Japan | 273/167 R |

*Primary Examiner*—Sebastiano Passaniti
*Attorney, Agent, or Firm*—Ladas & Parry

[57] ABSTRACT

There is disclosed a golf club with a metal head capable of achieving a longer driving distance. Super hard plating is applied to the metal head of the golf club. With this golf club, a driving distance is increased about 4% to 10%.

8 Claims, No Drawings

GOLF CLUB TREATED WITH PLATING

BACKGROUND OF THE INVENTION

This invention relates to a golf club treated with plating, and more particularly to a golf club having a head treated with super hard plating.

Heads of conventional golf clubs have been made of wood or metal, and recently many golf clubs have their heads made of metal. Representative examples of materials for such a metal head include aluminum, an aluminum alloy, stainless steel, titanium and a titanium alloy. With respect to the performance of a golf club, a driving distance of a ball, as well as a directional stability of a hit ball, is important.

Various proposals have heretofore been made with respect to the dimensions, shape and material of a head of a golf club to obtain a longer driving distance of a hit ball while securing a directional stability of a hit ball. It is known that the driving distance depends on the hardness of a hitting surface of a metal head if the metal head has the same dimensions and shape. In view of this, various proposals have heretofore been made in the prior art with respect to a material of a metal head; however, enhancing of the hardness of the head surface has not been taken into consideration at all.

SUMMARY OF THE INVENTION

It is an object of this invention to provide a golf club with a metal head capable of achieving a longer driving distance.

According to the present invention, there is provided a golf club having a head of metal treated with super hard plating.

In the golf club of the present invention, a hardness of the surface of the metal head is extremely high.

DESCRIPTION OF THE PREFERRED EMBODIMENT

In a preferred embodiment of the present invention, Ni alloy-plating is applied to a surface of a head of each of wood Nos. 1 to 5 to form a ternary alloy (Ni—B—W) film thereon.

In a test example, NIBOFRAM (Registered trademark) was used as an electroless plating solution. A weight of a head body was 200 g, and a plating film was 20μ in thickness and 3 g in weight. The hardness of the surface of the head was 350~450 Hv before the plating, and was 800 Hv after the plating.

Comparing the head before the plating with the head after the plating with respect to driving distances, the following results were obtained. More specifically, when measuring driving distances, using woods of the same specification and golf balls of the same specification, a man increased a driving distance from 200 yards to 220 yards, and a woman increased a driving distance from 180 yards to 197 yards. Thus, the driving distance was increased about 5~10%. Measurements were also carried out using a machine (SWING ANALYZER (Registered Trademark) marketed by Osawa Shokai and DISTANCE CADDIE (Registered Trademark) marketed by Bussan Sports Corporation, and measured driving distances for each wood are shown in Table 1. In this Table, the unit is yard.

TABLE 1

| Wood No. | No plating | Plating |
|---|---|---|
| 1 | 217.0 (192.5) | 219.0 (199.4) |
| 2 | 219.0 (196.0) | 239.0 (199.4) |
| 3 | 222.0 (196.0) | 236.0 (206.3) |
| 4 | 227.0 (192.5) | 232.0 (206.0) |
| 5 | 219.0 (196.0) | 231.0 (199.4) |
| Average | 220.8 (194.6) | 231.4 (202.1) |

It will be appreciated from this Table that a driving distance with the heads after the plating is about longer than a driving distance with the heads before the plating.

In this embodiment, although the Ni-alloy plating is used to form the ternary alloy film, hard chrome plating and any other suitable plating can be used.

In the present invention, merely by applying plating to a head of a golf club, there is obtained an advantage that a driving distance is increased about 4% to about 10%.

What is claimed is:

1. A golf club having a head of metal, with a super hard ternary alloy plating film formed on a surface of the head, said film comprising Ni, B and W.

2. In a golf club having a head of metal for use in driving a golf ball a driving distance, said head having a hitting surface of a certain hardness, the improvement wherein the hitting surface is coated with a ternary alloy film consisting essentially of Ni, B and W, said film having a hardness greater than the hardness of the hitting surface and being coated on the hitting surface in an amount sufficient to increase the driving distance of the golf club.

3. A golf club as claimed in claim 2 wherein the ternary alloy film consists essentially of NIBOFRAM.

4. A golf club as claimed in claim 3 wherein the film is coated on the surface with a thickness of about 20μ.

5. A method for increasing the driving distance of a golf club having a metal head, wherein the head has a hitting surface of a certain hardness, the method comprising coating the hitting surface with a ternary alloy film comprising Ni, B and W, said film having a hardness greater than the hardness of the hitting surface and being coated on the surface in an amount sufficient to increase the driving distance of the golf club.

6. A method as claimed in claim 5 wherein the film increases the driving distance of the golf club about 5–10%.

7. A method as claimed in claim 6 wherein the film is coated on the surface with a thickness of about 20μ.

8. A method as claimed in claim 6 wherein the film consists essentially of NIBOFRAM.

* * * * *